US012595968B2

(12) United States Patent
Friedlein et al.

(10) Patent No.: US 12,595,968 B2
(45) Date of Patent: Apr. 7, 2026

(54) COOLING DEVICE WITH A GUIDE SLEEVE

(71) Applicant: ebm-papst Mulfingen GmbH & Co. KG, Mulfingen (DE)

(72) Inventors: Florian Friedlein, Ravenstein-Hüngheim (DE); Josef Rathgeb, Jagstzell (DE); Lucas Schellmann, Altkrautheim (DE); Thomas Jäger, Weikersheim (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 232 days.

(21) Appl. No.: 17/862,446

(22) Filed: Jul. 12, 2022

(65) Prior Publication Data

US 2023/0017355 A1 Jan. 19, 2023

(30) Foreign Application Priority Data

Jul. 14, 2021 (DE) ..... 10 2021 118 148.8

(51) Int. Cl.

| | |
|---|---|
| ***F28F 13/06*** | (2006.01) |
| ***F28D 1/02*** | (2006.01) |
| ***F28F 9/00*** | (2006.01) |

(52) U.S. Cl.

CPC ..... *F28D 1/024* (2013.01); *F28F 9/002* (2013.01); *F28F 13/06* (2013.01); *F28F 2250/08* (2013.01)

(58) Field of Classification Search

CPC . F28D 1/024; F28F 9/002; F28F 13/06; F28F 2250/08; F01P 2070/50; F01P 11/10; F01P 5/06; F04D 29/54; F04D 29/545; F04D 29/547

See application file for complete search history.

(56) References Cited

U.S. PATENT DOCUMENTS

| | | | | |
|---|---|---|---|---|
| 4,685,513 | A | 8/1987 | Longhouse et al. | |
| 5,597,038 | A | 1/1997 | Potier | |
| 5,771,961 | A | 6/1998 | Alizadeh | |
| 2007/0209613 | A1 | 9/2007 | Pantow | |
| 2016/0297294 | A1* | 10/2016 | Bruemmer ..... | B60K 11/04 |

FOREIGN PATENT DOCUMENTS

| | | | |
|---|---|---|---|
| AT | 522171 | A4 | 9/2020 |
| DE | 3346705 | A1 | 7/1985 |
| DE | 102006037641 | A1 | 2/2008 |

(Continued)

*Primary Examiner* — Jianying C Atkisson
*Assistant Examiner* — Khaled Ahmed Ali Al Samiri
(74) *Attorney, Agent, or Firm* — Dickinson Wright PLLC

(57) ABSTRACT

A cooling device with a heat exchanger through which air flows and at least one fan arranged on the heat exchanger, forming a radial gap for generating airflow through the heat exchanger. The heat exchanger having a front face through which air flows which points toward the fan and is covered in portions by the fan, so that the front face is divided into a first subface that is at least partially covered by the fan and a second subface that is free of the fan. The cooling device has a guide sleeve arranged between the heat exchanger and the fan so as to close the radial gap at least in portions, forms a flow channel leading from an air outlet of the fan to the first subface of the front face, fluidically connects the air outlet to the first subface, and fluidically separates the same from the second subface.

13 Claims, 8 Drawing Sheets

(56) References Cited

FOREIGN PATENT DOCUMENTS

| | | | |
|---|---|---|---|
| DE | 102007036304 | A1 | 2/2009 |
| DE | 102009012025 | A1 | 9/2010 |
| DE | 102014210232 | A1 | 12/2015 |
| DE | 102018216090 | A1 | 3/2019 |
| EP | 0098397 | A1 | 1/1984 |
| FR | 2189697 | A2 | 1/1974 |
| KR | 20010065609 | A | 7/2001 |
| WO | 2013160832 | A1 | 10/2013 |

* cited by examiner

COOLING DEVICE WITH A GUIDE SLEEVE

CROSS REFERENCE TO RELATED APPLICATIONS

This application claims the benefit of priority under 35 U.S.C. § 119 to German Patent Application No.: 10 2021 118 148.8 filed Jul. 14, 2021, the contents of which is incorporated herein by reference in its entirety.

FIELD

The invention relates to a cooling device, particularly for motor vehicles, with a heat exchanger unit through which air can flow and a fan that is arranged on the heat exchanger unit so as to form a radial gap in order to generate an airflow through the heat exchanger unit, the fan being arranged on the front face of the heat exchanger unit or adjacent to a front face of the heat exchanger unit such that the fan covers a portion of the front face, so that the front face is subdivided into two or at least two subfaces that can be flowed against separately from one another by an airflow.

BACKGROUND

The statements in this section merely provide background information related to the present disclosure and several definitions for terms used in the present disclosure and may not constitute prior art.

A multitude of cooling devices with a heat exchanger unit and fans arranged thereon are available. It is possible for a heat exchanger unit to have one heat exchanger or a plurality of heat exchangers and, in particular, a plurality of successively arranged heat exchangers. A provision is usually made that the fan generates an airflow through the flow-through heat exchanger unit, whereby the air is heated as it flows through the heat exchanger unit and the air dissipates heat from the heat exchanger unit.

To this end, the fans are usually arranged directly adjacent to the heat exchanger unit, so that there is no structure between the fan and the heat exchanger unit that would impede the flow. However, such a fan usually does not rest directly against or on the heat exchanger unit, but is offset or spaced apart from the heat exchanger unit in the axial direction, so that a radial gap, i.e., a gap that is open in the radial direction, is formed between the heat exchanger unit and the fan.

Air can flow out of or into the space between the fan and the heat exchanger unit through this radial gap, with the effect that it is also able to flow back from a pressure side of the fan (the side on which the fan blows air out and thus generates an overpressure) to a suction side of the fan (the side on which the fan sucks in air), which is disadvantageous in several respects. This backflow of air can also be referred to as bypass flow.

If there is bypass flow, so that not all of the airflow generated by the fan is conveyed through the heat exchanger, the fan must either be operated at a higher power or a more powerful fan must be installed, resulting in higher power consumption compared to a solution with less or no bypass flow and a higher volume during operation.

Furthermore, the air can be sucked in again by the fan via this radial gap. Since bypass flow occurs primarily as a result of turbulent air, this repeated intake generates additional noise and thus leads to disadvantageous acoustics.

In addition, the air that is sucked in again via the bypass flow may have already been heated as a result of passing along the heat exchanger, so that sucking in air that has already been heated again leads to poorer cooling performance and consequently to reduced efficiency on the part of the cooling device.

To solve this problem, covers are known in the prior art, referred to as "hoods," "shrouds," or "air scoops," which enclose the fan for a heat exchanger or heat exchanger unit and completely cover the heat exchanger so that no air from the pressure side is able to flow back to the suction side of the fan. Such hoods are proposed, for example, by the documents EP 0 098 397 A1 and AT 522 171 A4.

However, if such cooling devices with hoods are to be used in motor vehicles, for example in order to enable cooling of the heat exchanger unit even when the vehicle is stationary, the heat exchangers or other coolers located behind a first cooling level of the heat exchanger unit, such as combustion coolers or charge air coolers, cannot be flowed against directly even by relative wind, but only via the fan, since the remaining front face of the heat exchanger unit is covered by the hood and cannot be flowed against directly. In order to solve this problem, the fan must, for example, be dimensioned so as to be sufficiently large to guarantee adequate cooling both with and without airflow, which in turn usually leads to higher costs, higher energy consumption, and higher volume.

WO 2013/160832 A1 discloses a hood provided with flaps that can be opened while driving so that the airflow can flow through the open flaps through the heat exchanger unit when driving. However, such a solution, which is provided with movable and partly sensory and actuating elements, is complex and subject to wear and tear and is therefore also disadvantageous.

SUMMARY

The present disclosure relates to a cooling device, particularly for motor vehicles, with a heat exchanger unit through which air can flow and a fan that is arranged on the heat exchanger unit so as to form a radial gap in order to generate an airflow through the heat exchanger unit, the fan being arranged on the front face of the heat exchanger unit or adjacent to a front face of the heat exchanger unit such that the fan covers a portion of the front face, so that the front face is subdivided into two or at least two subfaces that can be flowed against separately from one another by an airflow.

An objective of the present disclosure is therefore to overcome the aforementioned drawbacks by providing a cooling device that can provide efficient and adequate cooling in a simple manner both when the vehicle is moving and when it is stationary.

According to one aspect of the present disclosure, a cooling device with a heat exchanger unit through which air can flow and at least one fan that is arranged on the heat exchanger unit, forming a radial gap for generating an airflow through the heat exchanger unit is provided. The heat exchanger unit has a front face through which air can flow which points toward the fan and which is covered in portions by the fan, so that the front face is divided into a first subface that is at least partially covered by the fan and a second subface that is free of the fan. The cooling device has a guide sleeve which is arranged between the heat exchanger unit and the fan so as to close the radial gap at least in portions, forms a flow channel leading from an air outlet of the fan to the first subface of the front face, and fluidically connects the air outlet of the fan to the first subface of the front face and fluidically separates the same from the second subface.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

In order that the disclosure may be well understood, there will now be described various forms thereof, given by way of example, reference being made to the accompanying drawing, in which.

Figure 1:
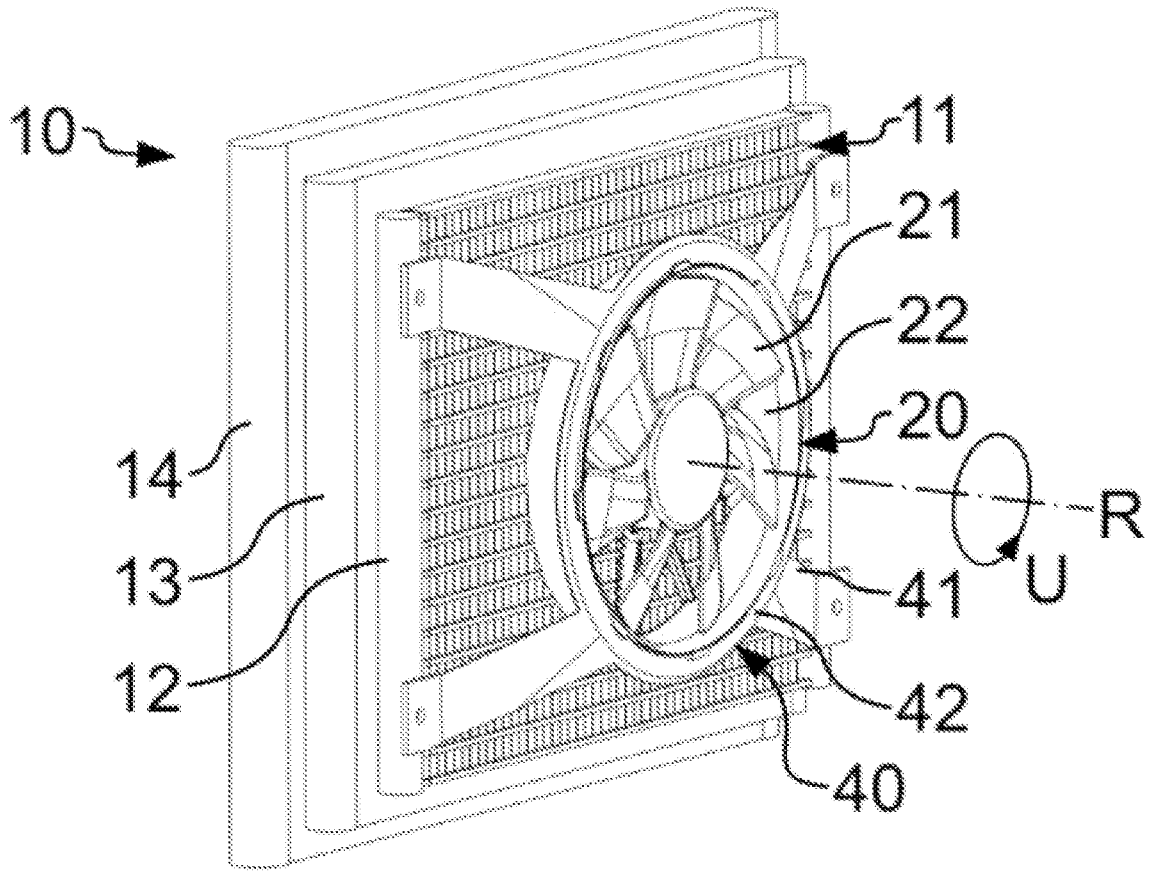
Fig. 1 (Prior Art)
FIG. 1 is a schematic representation of a conventional cooling device.

The drawings are provided herewith for purely illustrative purposes and are not intended to limit the scope of the present invention.

DETAILED DESCRIPTION

The following description is merely exemplary in nature and is in no way intended to limit the present disclosure or its application or uses. It should be understood that throughout the description, corresponding reference numerals indicate like or similar parts and structural and/or functional features.

Within this specification, embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

According to one aspect of the present disclosure, a cooling device is therefore provided, particularly for motor vehicles, which has a heat exchanger unit through which air can flow and at least one fan that is arranged on the heat exchanger unit, forming a radial gap for generating an airflow through the heat exchanger unit. The heat exchanger unit preferably has at least one heat exchanger, it also being possible for a plurality of heat exchangers to be arranged one behind the other in the direction of flow of the air. The fan, which is composed particularly and substantially of an impeller that can be rotated about an axis of rotation and a housing that surrounds the impeller in the circumferential direction about the axis of rotation and has an air outlet toward the heat exchanger unit, is arranged on the front side and preferably directly adjacent to the heat exchanger unit so that no structures impeding an airflow between fan and heat exchanger unit extend therebetween.

Since the heat exchanger unit and the fan are spaced apart from one another in the axial direction relative to the axis of rotation without touching one another, a gap is formed between the heat exchanger unit and fan that is open in the radial direction relative to the axis of rotation and referred to as the radial gap. Analogously to a gap that is open in the radial direction and referred to as a radial gap, a gap that is open in the axial direction is referred to as an axial gap. Alternatively, radial gap and axial gap can be defined in such a way that an axial gap extends parallel to the axis of rotation and/or can be flowed through parallel to the axis of rotation and that a radial gap extends orthogonally to the axis of rotation and/or can be flowed through orthogonally to the axis of rotation.

According to another aspect of the present disclosure, a further provision is made that the heat exchanger unit and, in particular, a heat exchanger of the heat exchanger unit that is nearest the fan has a front face which is partially covered by the fan that points toward the fan and allows air to flow through, so that the front face is divided into a first subface that is at least partially covered by the fan and a second subface that is free of the fan. If a base area of the fan is projected parallel to the axis of rotation onto the front face of the heat exchanger unit, the base area that is projected onto the front face is in the first subface and outside of the second subface, with the second subface adjoining the first subface and surrounding the same in the manner of a frame, for example. Although the first subface can be equal to the base area that is projected onto the front face, the first subface may also be larger than the base area that is projected onto the front face. It is essential that the cooling device according to the invention have a guide sleeve, which can also be referred to as an air guide sleeve.

The guide sleeve can be flowed through particularly in the axial direction, i.e., along or parallel to the axis of rotation, and is therefore designed to guide air or a flow. Furthermore, the guide sleeve between the heat exchanger unit and the fan is arranged to close the radial gap therebetween at least in portions and forms a flow channel through which air can flow which leads from an air outlet of the fan to the first subface of the front face of the heat exchanger unit. The expression 'arranged between the heat exchanger unit and the fan' means that the guide sleeve extends in the axial direction at least in portions between the front face of the heat exchanger unit and the fan, but in particular that it can also cover the fan in portions or overlap therewith. The radial gap is closed or covered radially outward at least in portions by the guide sleeve. The guide sleeve preferably completely closes the radial gap between the heat exchanger unit and the fan.

Furthermore, the guide sleeve fluidically connects the air outlet of the fan to the first subface of the front face and fluidically separates the air outlet from the second subface. A flow can also be understood as being fluidically separated if a flow from the air outlet to the second subface is negligibly small compared to a flow from the air outlet to the first subface and, for example, is less than 5% of the flow from the air outlet to the first subface. This means that the airflow that can be generated by the fan can be directed through the guide sleeve or the flow channel formed by the same directly onto or through the first subface of the front face of the heat exchanger unit, but that a backflow from a pressure side at the air outlet of the fan to a suction side of the fan is minimized by the radial gap.

Furthermore, the second subface of the front face of the heat exchanger unit preferably remains free of the guide sleeve and can therefore be flowed through, so that flow that is independent of the fan, such as relative wind, can travel unhindered onto or through the second subface, at least from the guide sleeve.

According to another aspect of the present disclosure, the guide sleeve is preferably arranged on the front face in or at a boundary between the first subface and the second subface so that they are structurally separated from one another by the guide sleeves.

If not just one fan but a plurality of fans are provided, these can be arranged next to one another on the heat exchanger unit so that each fan determines a first subface on the front face of the heat exchanger unit. In this case, a guide sleeve that connects the respective air outlet to the respective first subface is provided for each fan.

In addition to other possible configurations, one advantageous refinement makes a provision that the guide sleeve is embodied as a hollow cylinder and/or is rotationally symmetrical, with the guide sleeve being arranged coaxially with the axis of rotation of the fan impeller.

As an alternative to a hollow cylindrical basic shape, the guide sleeve can also be funnel-shaped or it can be embodied as a hollow truncated cone whose diameter preferably increases from the air outlet of the fan to the front face of the heat exchanger unit.

As a matter of principle, several different variants can be considered for the guide sleeve. The guide sleeve can be provided as a component that is separate from the heat exchanger unit and the fan, can be arranged between the heat exchanger unit and the fan, and optionally contacts the heat exchanger unit and/or the fan. Furthermore, the guide sleeve can be formed integrally or in a single piece with the heat exchanger unit and extend toward the fan.

Alternatively, the guide sleeve can be formed integrally or in a single piece with the fan and extend toward the heat exchanger unit. In addition, a first part of the guide sleeve can also be formed separately or integrally or in a single piece with the heat exchanger unit or a heat exchanger of the heat exchanger unit and a second part of the guide sleeve can be formed separately or integrally or in a single piece with the fan, with the first part of the guide sleeve and the second part of the guide sleeve overlapping or abutting one another on facing sides.

According to yet another aspect of the present disclosure, one especially advantageous variant makes a provision that the guide sleeve is formed integrally by the heat exchanger unit or is connected thereto in a single piece. In that case, the guide sleeve can also be mounted in an integral/form-fitting/frictional manner on the front face of the heat exchanger of the heat exchanger unit that is nearest the fan, for example.

The guide sleeve can rest directly against the fan or have a radial gap relative to the fan due to spacing from the fan in the axial direction, or it can have an axial gap relative to the fan due to a larger inside diameter than the outside diameter of the fan, for example.

A sealing element that closes the respective gap can also be provided in such a radial or axial gap. It is also advantageous if the area of the radial or axial gap between the guide sleeve and the fan that can be flowed through is smaller than the area of the radial gap between the fan and the heat exchanger unit that can be flowed through, so that the backflow of air from a pressure side to a suction side of the fan is minimized.

If a sealing element is provided, it can also be embodied in the manner of a bellows or an apron and, in particular, be flexible or deformable in the axial direction. By moving the fan or the guide sleeve in the direction of the front side of the heat exchanger unit, the apron/bellows/the sealing element can be elastically compressed so that substantially no force acts on the front side but the gap between the front side of the heat exchanger unit and the guide sleeve remains closed.

In addition, a provision can be made that the fan has a wall on the heat exchanger side that extends around the axis of rotation in the circumferential direction and overlaps with the guide sleeve in the axial direction along the axis of rotation, so that the guide sleeve in particular completely extends around or surrounds the wall of the fan in the circumferential direction or the wall of the fan the guide sleeve in particular completely extends around or surrounds the same in the circumferential direction. The wall of the fan can be part of the housing of the fan and delimit an interior space of the fan through which air can flow in the axial direction.

If a provision is made that the guide sleeve overlaps with the wall of the fan and rests against the same, a stop can be provided on the guide sleeve which limits the displacement of the guide sleeve relative to the fan or the wall thereof. Furthermore, the mutually facing and directly abutting surfaces of the guide sleeve and wall of the fan can be embodied as a fit and in particular as a transition or press fit, so that the guide sleeve and the fan can be plugged into one another without the absolute need for any other fastening means and in a substantially flow-tight manner, i.e., as to prevent flow.

Furthermore, a variant of the cooling device in which the guide sleeve is formed integrally by the fan or connected thereto in a single piece, for example by gluing, is also especially advantageous. Alternatively, however, the guide sleeve can also be connected to the fan in an integral/form-fitting or frictional manner.

In this case as well, the guide sleeve can rest directly against the heat exchanger unit or have a radial gap relative to the heat exchanger unit due to a spacing from the heat exchanger unit in the axial direction. A sealing element that closes the gap can also be provided in such a radial gap. In addition, it is also advantageous here if a flowable area of the radial gap between guide sleeve and heat exchanger unit is smaller than a flowable area of the radial gap between fan and heat exchanger unit, so that the backflow of air from a pressure side to a suction side of the fan is minimized.

As described above and further defined herein, a sealing element can also be arranged in a radial gap between the heat exchanger unit and the air guiding sleeve by means of which the radial gap is closed at least in portions.

According to another aspect of the present disclosure, one especially advantageous variant makes a provision that the sealing element is embodied as a bellows or a skirt and has a first end that is secured to the guide sleeve in the axial direction and a free, oppositely situated second end in the axial direction. Furthermore, the sealing element is designed to be stretched in the axial direction by the airflow generated by the fan from a non-deformed first position into a deformed second position, so that the radial gap is particularly completely closed in the second position.

For example, in its non-deformed position, the sealing element can form a flow resistance in or at the flow channel from the air outlet of the fan to the front face of the heat exchanger unit. If the airflow or an airflow that is sufficiently large as specified applies a predetermined force to the portion of the sealing element that provides the flow resistance, the sealing element can be deformed and thereby stretched in the axial direction. In the deformed second position, the sealing element can also bear directly against the front face. If the airflow decreases, the sealing element is compressed from the second position back into the first position, preferably due to its elasticity. The deformation behavior or the stretching as a function of the airflow generated by the fan can also be determined by an appropriately matched elasticity and/or rigidity of the sealing element and by the geometry of the portion of the sealing element extending into the flow channel. Such a sealing element that is embodied as a bellows or apron can be formed particularly by a film made of plastic, for example.

Another advantageous refinement of the cooling device also makes a provision that the guide sleeve is dimensionally stable or rigid and made of plastic, for example, with rigid or dimensionally stable being understood to mean that the guide sleeve is not deformed or cannot be deformed when used as intended.

In a different embodiment, the guide sleeve could also be flexible or elastic at least in portions, which is the case, for example, when a sealing element is molded directly against a dimensionally stable or rigid portion of the guide sleeve.

In order to simplify the connection of the guide sleeve to the heat exchanger unit and/or fan and to enable forces to be dissipated over a larger area, one advantageous variant of the cooling device also makes a provision that the guide sleeve has a circumferential wall in the circumferential direction and a flange that extends beyond the wall in the radial direction on the heat exchanger side and/or fan side. In that case, the guide sleeve can continue to be integrally formed or particularly formed in a single piece. The flange can provide a connection surface for joining to the adjoining heat exchanger unit or the adjoining heat exchanger or fan that is larger than a front face of the wall of the guide sleeve. For example, the flange can be secured to the front face in an integral, form-fitting, or frictional manner via the connection surface.

The flange can extend radially inward and/or radially outward beyond the wall. The wall and the flange can be integrally connected to one another, so that the flange is an integral part of the guide sleeve. Alternatively, however, the flange can also be provided as a separate component that is distinct from the guide sleeve, in which case the flange must be secured to the wall of the guide sleeve. If the guide sleeve is formed integrally with the fan, the wall of the guide sleeve can also constitute the wall of the fan.

According to another aspect of the present disclosure, another advantageous refinement makes a provision that the flange has a deformation element and/or a multitude of bristles toward the front face, by means of which the flange is designed to penetrate through the front face into the heat exchanger unit, more particularly the heat exchanger of the heat exchanger unit, that is arranged immediately adjacent to the flange. For one, this enables the flange to be affixed in a simple manner, at least with respect to a movement parallel to the front face thereof or of the heat exchanger unit and, for another, the radial gap between the front face and the fan can be further reduced. The bristles can be made of an elastic material.

A flange on the heat exchanger side can be used not only for the connection, but also for improved pressure or force distribution on the heat exchanger unit or the heat exchanger nearest the fan. The heat exchanger can be extremely filigree and hence sensitive. If a force transmitted from the guide sleeve to the heat exchanger were to be distributed over an area that is too small—e.g., the front face of the wall—the heat exchanger could be damaged. In order to prevent such damage, the force can be distributed over a larger area compared to a solution without a flange through the surface of the flange facing toward the heat exchanger, which reduces the pressure acting on the heat exchanger or on the front face of the heat exchanger and enables the heat exchanger to withstand the pressure.

A provision can preferably also be made for the axis of rotation of the fan impeller to be coaxial with a central axis of the heat exchanger unit, which is orthogonal to the front face and extends centrally through the front face, so that the fan is arranged centrally on the heat exchanger unit. The cooler is thus arranged in the center of the front face. The expression 'extending centrally through the front face' is understood to mean particularly extending through the geometric center of gravity of the front face. The arrangement of the fan as centrally as possible on the front face or securing the fan as centrally as possible on the front face is intended to suppress or prevent opposing vibrations on the fan that can move the fan to an unacceptable degree and damage the heat exchanger unit. For example, the oscillations or general vibrations on the fan can cause the fan to move in the axial direction and strike the front face and press into the heat exchanger unit.

A guide sleeve that is secured to the heat exchanger unit by means of a flange, rests directly against the front face, and has an axial gap relative to the fan can especially advantageously have a stop element on the heat exchanger side that is designed to limit a maximum axial movement of the fan relative to the guide sleeve. If there is an oscillation or vibration on the fan that causes an axial movement of the fan, the latter can move freely through the axial gap relative to the guide sleeve. If the axial movement is too great to the extent that the fan would strike the front face, the fan instead comes to rest against the contact element of the guide sleeve, so that the fan does not strike the heat exchanger unit, but rather a force that would otherwise act directly on the front face when striking the flange can be dissipated over a large area on the front face.

In order to enable the fan to be secured to the heat exchanger unit, the cooling device preferably also has a fan holding element that is designed to secure the fan in a fixed position relative to the heat exchanger unit and to form the radial gap relative to the fan.

If the heat exchanger unit is intended for use with a guide sleeve, the heat exchanger unit and, in particular, the heat exchanger of the heat exchanger unit nearest the fan can also have a support structure against which the guide sleeve can rest over its entire surface and which is designed to withstand and/or dissipate a force transmitted from the guide sleeve to the heat exchanger. The guide sleeve can also be resiliently pressed against the front face by spring elements, or it can itself be resilient.

Further important characteristics and advantages of the invention are now described with associated description of the figures, with reference to the drawings. It is understood that the above-mentioned characteristics, and those to be described hereinafter, are not only applicable in the respective combination indicated, but also in other combinations, or in isolation, without departing from the scope of the present invention.

Figure 2:
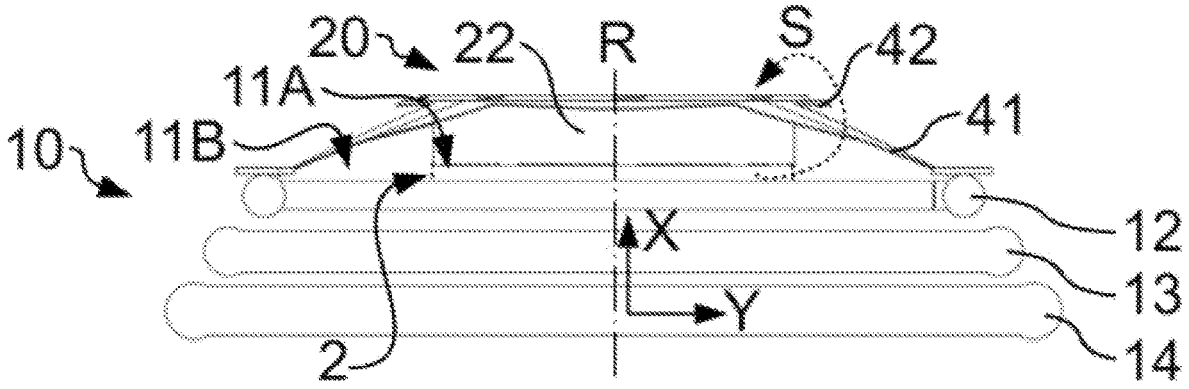
Fig. 2 (Prior Art)
FIG. 2 represents a side-view of the conventional cooling device of FIG. 1.

FIGS. 1 and 2 show a conventional cooling device for a motor vehicle which is known in the prior art and forms the starting point for the cooling device formed according to the present disclosure. The conventional cooling device is shown in perspective in FIG. 1 and in a side view in FIG. 2. Referring to FIGS. 1 and 2, the heat exchanger unit 10 consists, for example, of a plurality of components or of a plurality of individual heat exchangers and, here, of a condenser 12 for an air conditioning system, a charge air cooler 13, and a water cooler 14. The heat exchanger unit 10 can also have different or more or fewer components, with at least one cooling element or heat exchanger—here the condenser 12—being provided directly adjacent to the fan 20.

A fan 20 is arranged immediately adjacent to the heat exchanger unit 10 or condenser 12 but offset thereto in the axial direction X, i.e., at a distance from a front face 11 of the heat exchanger unit 10, so that a radial gap 2 is formed between the heat exchanger unit 10 and the fan 20 which extends in the radial direction Y.

The fan 20, which can also be referred to as a ventilator, consists substantially of an impeller 21 that is arranged in the interior of a housing through which air can flow in the axial direction X, can be driven—for example by an electric motor—and can be rotated about an axis of rotation R, with the axial direction X extending along or parallel to the axis of rotation R.

Furthermore, the fan 20 is held in a fixed position relative to the heat exchanger unit 10 by a fan holding element 40. If the surrounding construction allows the fan 20 to be secured in a different manner relative to the heat exchanger unit 10 and, for example, to other components of a vehicle, such a fan holding element 40 can be dispensed with.

Still referring to FIGS. 1 and 2, the fan holding element 40 has four (first) struts 41 that extend radially outward from a ring element or fan frame 42 extending around the fan 20 in the circumferential direction U about the axis of rotation R via the front face 11, thereby spanning over the front face 11.

The fan 20 partially covers the front face 11 of the heat exchanger unit as viewed along the axis of rotation R, so that the front face 11 is divided into a first subface 11A and a second subface 11B, as shown in FIG. 2. The first subface 11A corresponds to the base area of the fan 20 that is projected onto the front face 11 and the second subface 11B to the remaining area of the front face 11 of the heat exchanger unit 10 surrounding the first subface 11A in a frame-like manner.

When the motor vehicle moves sufficiently quickly (during travel), the resulting relative wind flows against the cooling device parallel to the axis of rotation R or in the axial direction X, so that the relative wind blows through the interior of the fan 20 which can be flowed through in the axial direction X to the first subface 11A and strikes the second subface 11B outside of the fan 20, flows through the heat exchanger unit 10, and is capable of providing adequate cooling of the heat exchanger unit 10.

When the vehicle is stationary, however, at least some of the components of the heat exchanger unit 10 should continue to be cooled, for example in order to enable the vehicle's air conditioning system to be operated even when the vehicle is stationary, or in order to enable continued cooling of the engine. Since no relative wind flows through the heat exchanger unit 10 when it is stationary, the fan 20 or its impeller 21 is driven and an airflow is thereby generated at least on the first subface 11A which flows through the heat exchanger unit 10.

Due to the radial gap 2, there is now a backflow S from a pressure side to a suction side of the fan 20, so that a portion of the flow that is generated as bypass flow or backflow S by the fan does not flow through the heat exchanger unit 10. To compensate for this backflow S, a more powerful fan 20 must be used, or the fan 20 must be operated at a higher speed or with higher power, which, in addition to the increased energy consumption, leads to a higher noise level.

Figure 3:
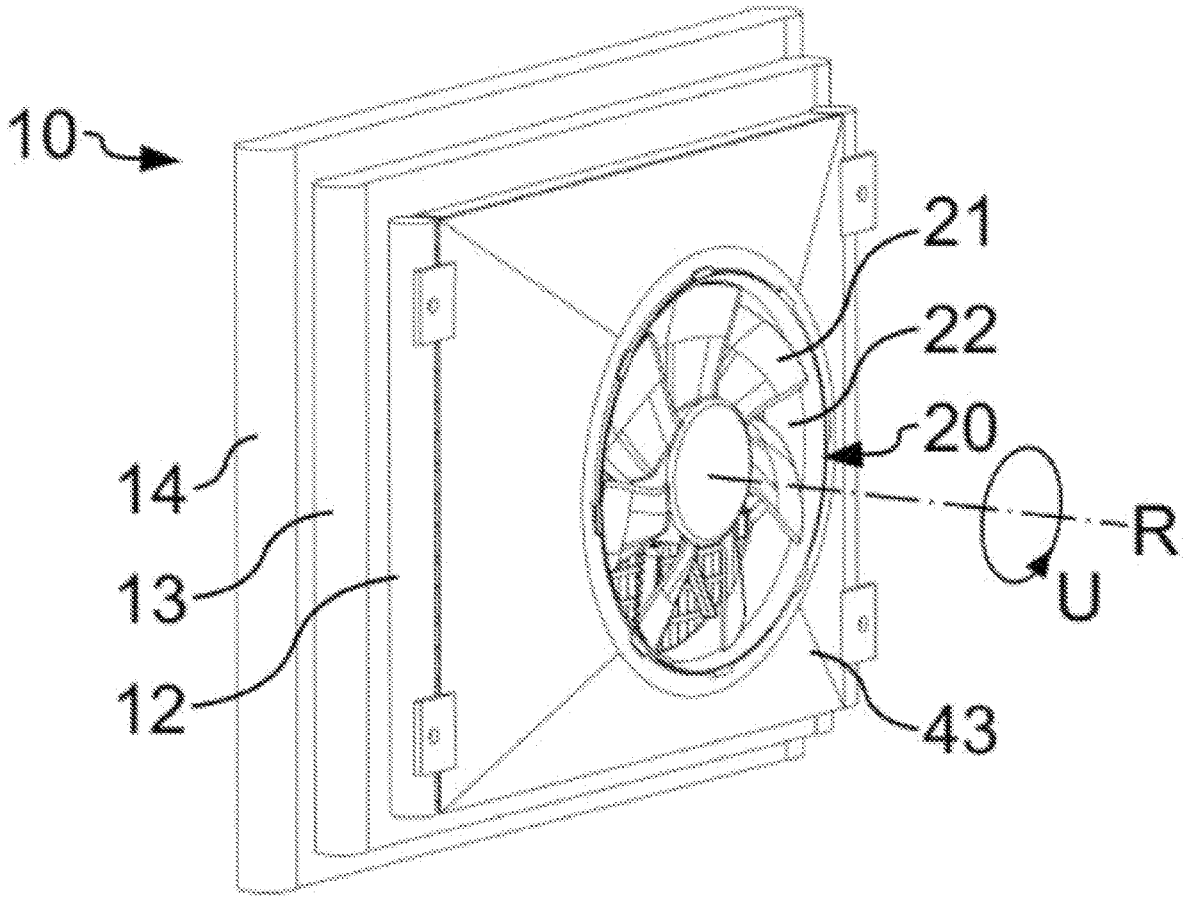
Fig. 3 (Prior Art)
FIG. 3 is a schematic representation of another conventional cooling device.

Referring now to FIG. 3, to solve this problem, a hood 43 is known in the prior art by means of which the pressure side is separated from the suction side of the fan 20, so that no backflow S is possible and the entire airflow generated by the fan 20 passes through the heat exchanger unit 10 with a cooling effect.

However, this solution as shown in FIG. 3 is only advantageous when the vehicle is stationary, since if the vehicle is traveling at a sufficient speed, the wind can no longer flow directly against the second subface 11B, so that even with sufficient travel or sufficient wind, cooling is possible only via an airflow which flows against a first subface 11A or a flow which passes through the fan 20.

Figure 4:
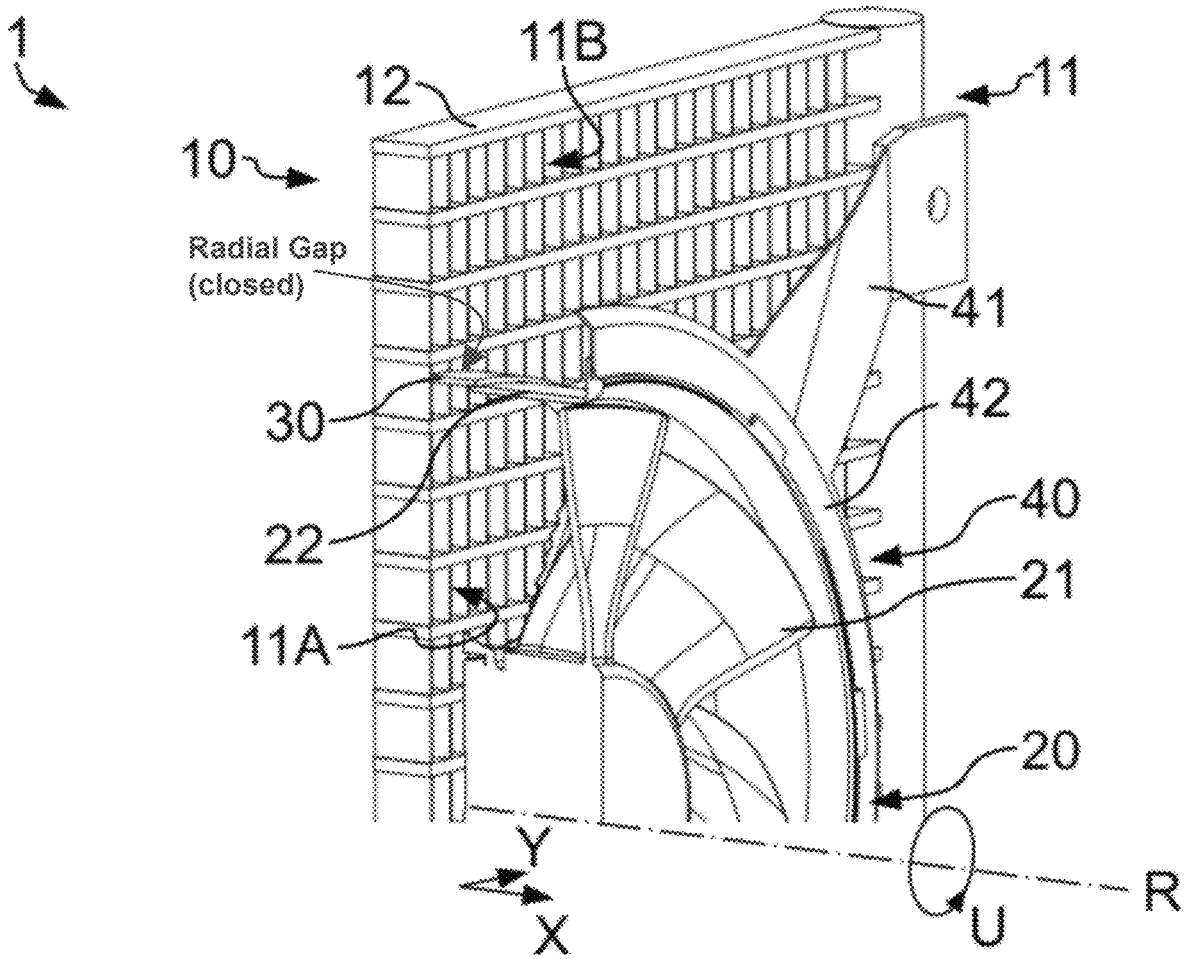
FIG. 4 is a schematic representation showing a cut-out of a first embodiment for a cooling device according to the teachings of the present disclosure.
Figure 5:
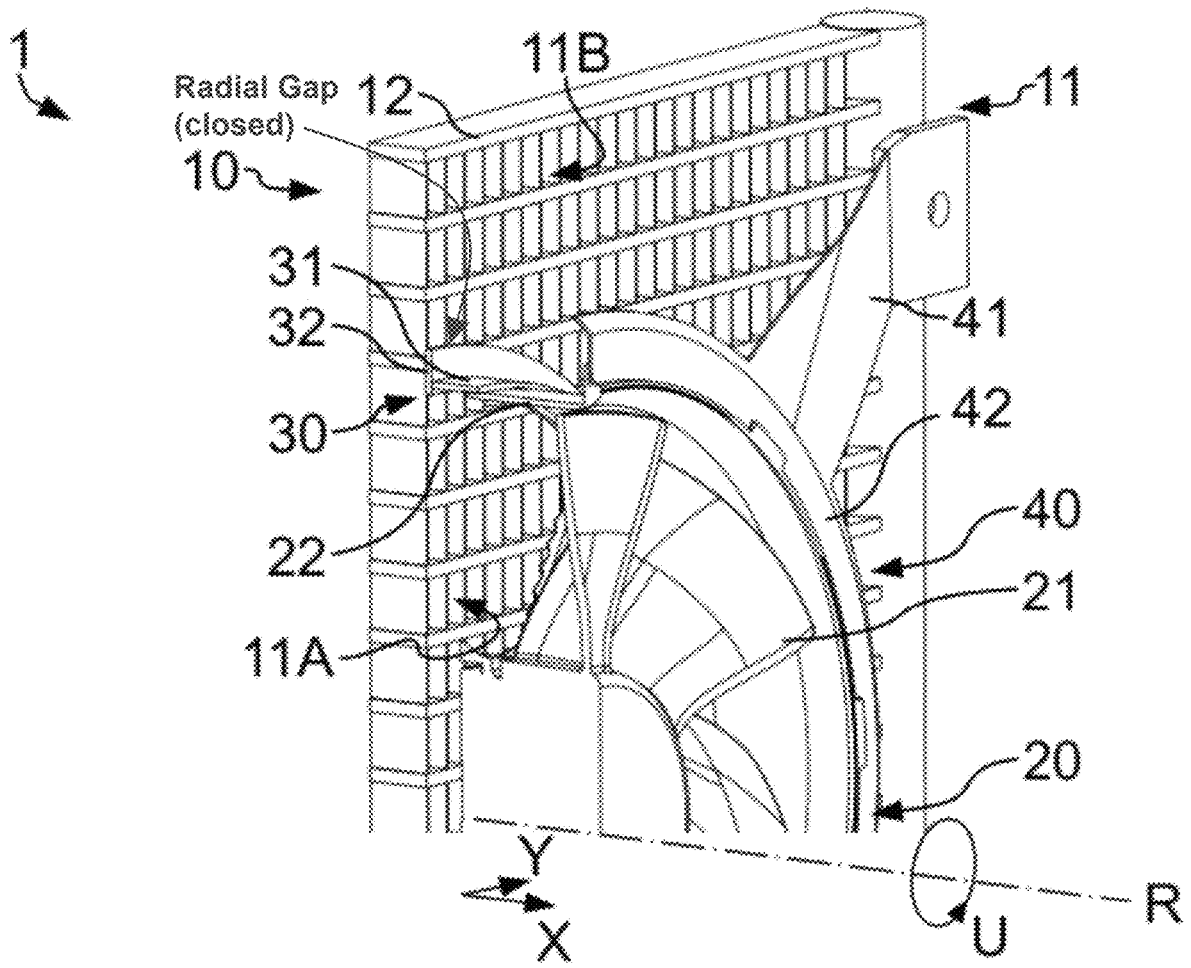
FIG. 5 is a schematic representation showing a cut-out of a second embodiment of a cooling device according to the teachings of the present disclosure.
Figure 6:
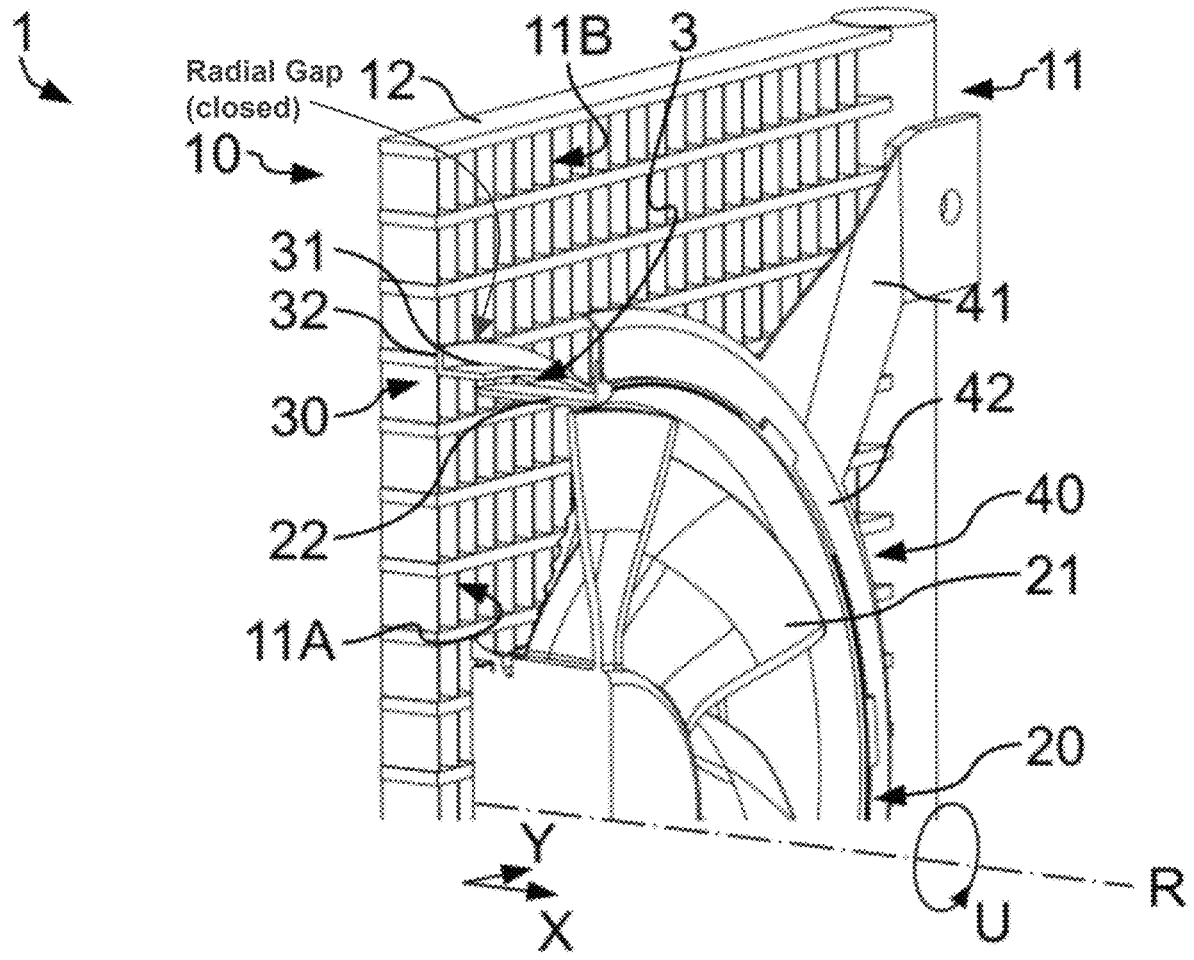
FIG. 6 is a schematic representation showing a cut-out of a third embodiment of a cooling device according to the teachings of the present disclosure.

Cooling devices 1 of the present disclosure that solve this problem are shown in detail and in perspective in various design variants in FIGS. 4 to 6, with each figure corresponding to a variant. The basic structure corresponds to that shown in FIG. 1 and FIG. 2, so the associated explanation of FIGS. 1 and 2 applies analogously to the cooling devices 1 as shown in FIGS. 4 to 6. The main difference from the cooling device according to FIGS. 1 and 2 is that the cooling devices 1 of FIGS. 4 to 6 each have a guide sleeve 30 which completely or at least partially closes the radial gap 2 and thereby completely prevents or at least minimizes a backflow S from the pressure side of the fan 20 to the suction side of the fan 20.

FIGS. 4 to 6 only show the uppermost component or the component (condenser 12) which is immediately adjacent to the fan 20 of the heat exchanger unit 10 and forms the front face 11, it also being possible for additional levels or components of the heat exchanger unit 10 to be provided on the side of the component (condenser 12) that is facing away from the fan 20 (e.g., charge air cooler 13 and/or water cooler 14).

Referring now to FIG. 4, a provision is made that the guide sleeve 30 rests against the heat exchanger unit 10 on its side facing toward the heat exchanger unit 10 and abuts with its front face on the heat exchanger side against substantially the entire surface on the front face 11 of the heat exchanger unit 10 or of the component nearest the fan. On its side facing toward the fan 20, the guide sleeve 30 overlaps in portions with the wall 22 of the fan 20 in the axial direction X, so that the interior of the fan 20 through which air can flow in the axial direction X transitions directly and, in particular, tightly into the flow channel that is formed by the guide sleeve 30.

Although a provision is made in FIG. 4 that the guide sleeve 30 rests with a radially inner surface against a radially outer surface of the wall 22 of the fan 20, a provision can also be alternatively made that the guide sleeve 30 rests with a radially outer surface against a radially inner surface of the wall 22 of the fan 20. Furthermore, stops that limit the overlapping and displaceability of the guide sleeve 30 on the fan 20 can be provided on the radially inner surface and/or the radially outer surface of the guide sleeve 30 and/or wall 22.

Still referring to FIG. 4, the guide sleeve 30 can, for example, be secured in a fixed manner to the heat exchanger unit 10, and the fan 20 can be movable relative to the guide sleeve 30 or secured in a fixed manner to the fan 20 and be movable relative to the heat exchanger unit 10.

Furthermore, the guide sleeve 30 can also be movable relative to both the heat exchanger unit 10 and the fan 20, in which case the guide sleeve 30 is resiliently pressed from the side of the fan 20 by spring elements (not shown) against the front face 11 of the heat exchanger unit 10.

The radial gap 2 is completely closed in each case, so that the backflow S through the radial gap 2 is blocked or suppressed in a substantially complete manner.

The variant shown in FIG. 5 differs from the embodiment shown in FIG. 4 in that the guide sleeve 30, in addition to a wall 31 that extends in the axial direction X and encloses or surrounds the wall 22 of the fan 20 in the circumferential direction U, also has a flange 32 which extends in the radial direction Y beyond the wall 31 of the guide sleeve 30 and by means of which the contact surface of the guide sleeve 30 on the front face 11 of the heat exchanger unit 10 is enlarged. Here, the flange 32 extends both radially inward and radially outward beyond the wall 31 of the guide sleeve 30, it also being possible for only an extension radially outward or radially inward to be provided.

This may be advantageous in several respects. If the guide sleeve 30 is integrally connected to the heat exchanger unit 10 or front face, for example by gluing, the adhesive surface and hence the stability of the connection is increased by the flange 32. Alternatively, if the guide sleeve 30 is connected to the fan 20 in a fixed position, the guide sleeve 30 resting against the front face 11 of the heat exchanger unit 10 must not be subjected to excessive force or pressure on the front face 11, as this could damage the heat exchanger unit 10. The contact surface is enlarged by the flange 32 and the force is thereby distributed over a larger surface and the pressure on the front face 11 or on the heat exchanger unit 10 is reduced.

In the variant according to FIG. 6, the guide sleeve 30 also has a flange 32, the main difference from the embodiment of FIG. 5 being that the guide sleeve 30 has an inner diameter that is greater than an outer diameter of the wall 22 of the fan 20, so that the guide sleeve 30 does overlap in portions with the wall 22 of the fan 20 in the axial direction X, but they do not abut against one another, whereby an axial gap 3 is formed therebetween. The guide sleeve 30 is preferably secured to the heat exchanger unit 10, for example preferably by gluing to the front face 11 of the heat exchanger unit 10, so that the fan 20 can move freely relative to the guide sleeve 30 through the axial gap 3 at least along the axial direction X. An oscillation or vibration of the fan 20 that brings about an axial movement of the fan 20 therefore does not result in the fan 20 or the guide sleeve 30 being pressed against the front face 11 of the heat exchanger unit 10 and the latter being damaged, or only in the event of very strong vibrations. It is also essential here that the area of the axial gap 3 through which flow can occur be smaller than the area of radial gap 2 between heat exchanger unit 10 and fan 20 through which flow can occur, so that the backflow S is not completely prevented, but minimized.

Figure 7A:
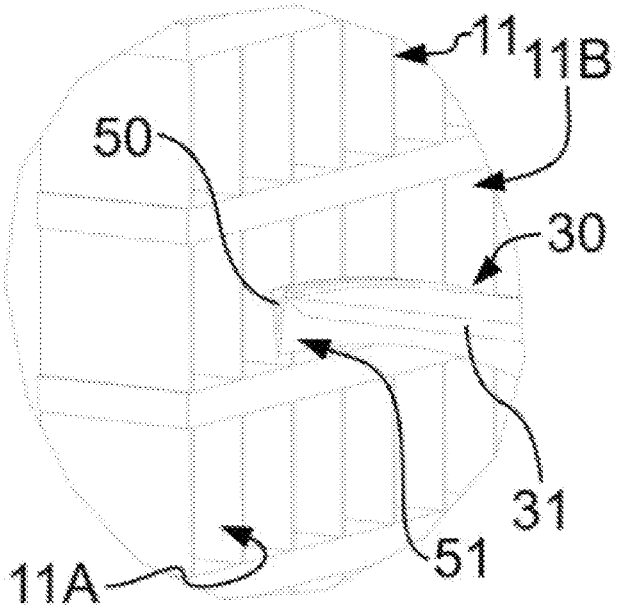
FIG. 7A is a schematic representation showing a cut-out of an embodiment of the cooling device with a sealing element in a first (starting) position.
Figure 7B:
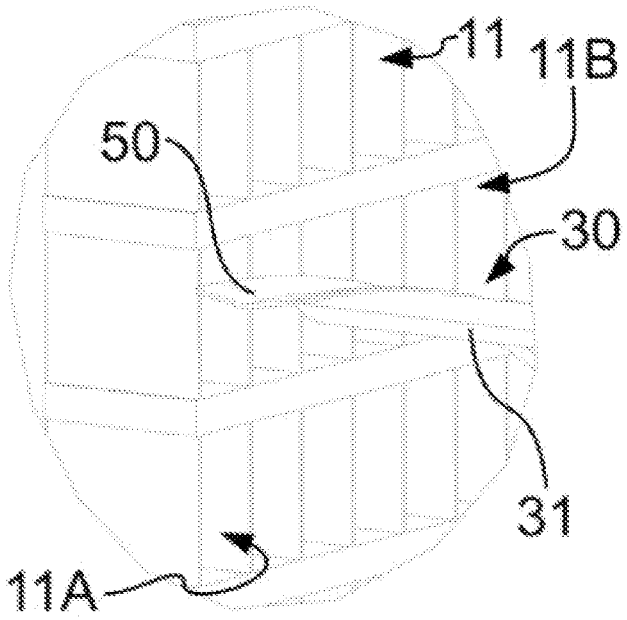
FIG. 7B is a schematic representation showing a cut-out of an embodiment of the cooling device with a sealing element in a second (stretched) position.

Referring now to FIGS. 7A and 7B, an enlarged section of a variant is shown in which a remaining gap between the wall 31 of the guide sleeve 30 and the front face 11 can be closed by a sealing element 50 that is elastically deformable in the axial direction X or is closed automatically if the airflow is sufficiently strong. According to the variant that is shown in FIGS. 7A and 7B, the guide sleeve 30 of the cooling device is arranged with a radial gap relative to the heat exchanger unit 10, more particularly to the front face 11 thereof. Furthermore, a sealing element 50 that closes the radial gap is arranged between the guide sleeve 30 and the heat exchanger unit 10 and is embodied as a bellows or bellows-like film. The sealing element 50 has a first end that is fixed to the guide sleeve 30 or to the wall 31 of the guide sleeve 30 in the axial direction X, as well as a free second end that is situated oppositely in the axial direction X.

If no airflow or an airflow below a predetermined limit value is generated by the fan 20, the sealing element 50 is in its starting position (first position) as shown in FIG. 7A. The sealing element 50 extends with a portion 51 into the airflow channel from the air outlet of the fan 20 to the front face 11 of the heat exchanger unit 10, thereby forming a flow resistance. If the airflow generated by the fan 20 exceeds a predetermined lower limit value, so that a force acting through the airflow on the portion 51 of the sealing element 50 exceeds a predetermined value, the sealing element 50 is deformed as a function of the airflow and stretched from its secured or fixed position in the axial direction X to its free end, so that the sealing element 50 completely or at least partially closes the radial gap as soon as the airflow exceeds a predetermined upper limit value.

In FIG. 7B, the sealing element 50 is in its second, completely deformed or stretched position in which it bears against the front face 11. It should be noted here that the deformation, i.e., the stretching of the sealing element 50, increases as the airflow increases, so that the radial gap is or will be closed depending on the airflow generated by the fan 20.

The sealing element 50 is embodied in the manner of a bellows, so that the sealing element 50 is compressed when the guide sleeve 30 moves toward the front face 11 and continues to close the gap without applying a force to the front face 11 that would damage the heat exchanger unit 10. A state is shown in FIG. 7A in which the sealing element 50 is substantially undeformed. In FIG. 7B, the guide sleeve 30 is displaced in the axial direction X in the direction of the front face 11, and the sealing element 50 is correspondingly deformed.

Figure 8:
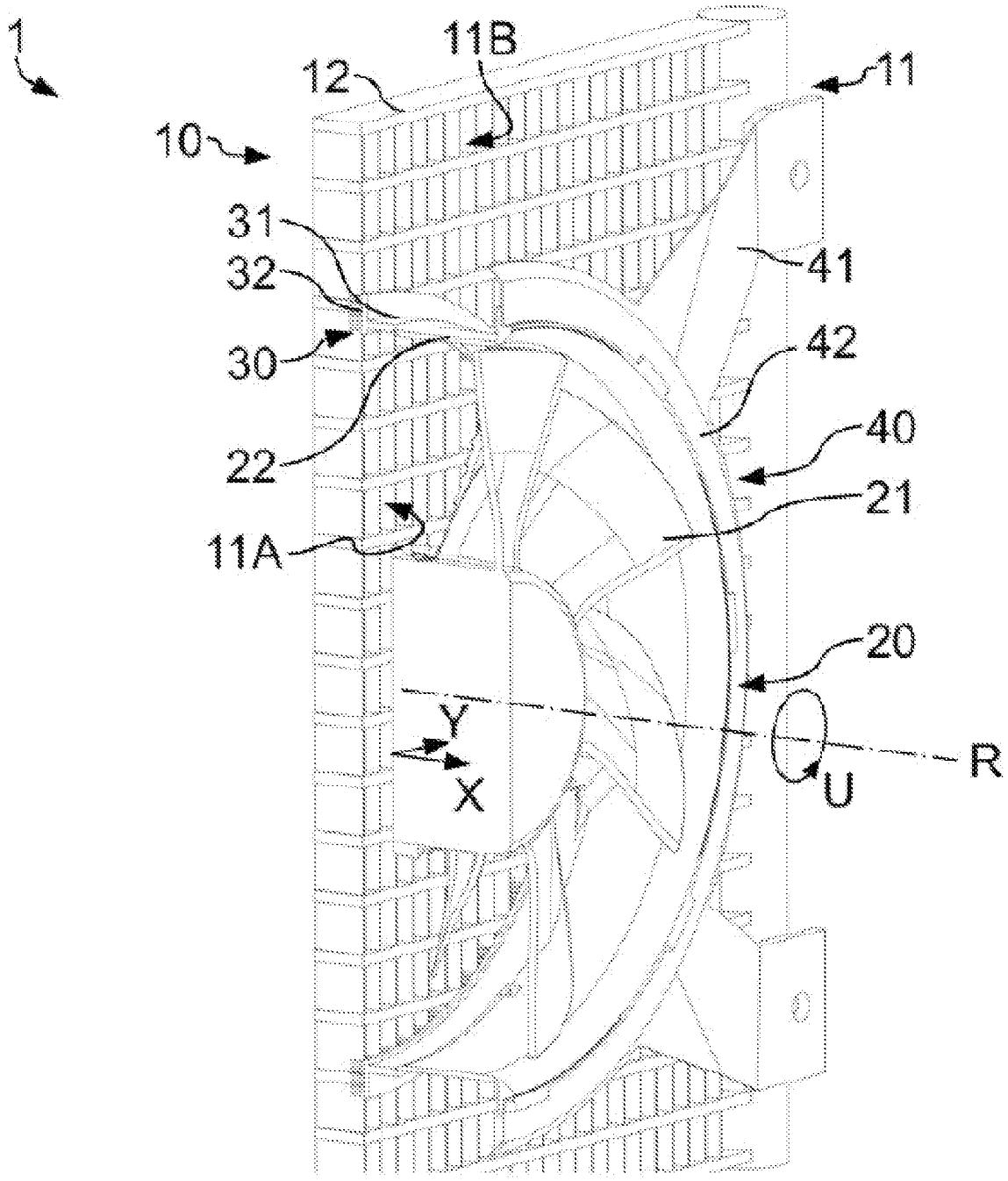
FIG. 8 is a schematic representation showing a cut-out of an embodiment of the cooling device with bristles.

FIG. 8 corresponds to a variant according to FIG. 5 in which bristles are provided on a side or surface of the flange 32 facing toward the front side 11, these bristles penetrating into the heat exchanger unit 10, here more particularly the condenser 12, thereby securing the flange 43 on the heat exchanger unit 10 against movement parallel to the front face 11.

The foregoing description of various forms of the invention has been presented for purposes of illustration and description. It is not intended to be exhaustive or to limit the invention to the precise forms disclosed. Numerous modifications or variations are possible in light of the above teachings. The forms discussed were chosen and described to provide the best illustration of the principles of the invention and its practical application to thereby enable one of ordinary skill in the art to utilize the invention in various forms and with various modifications as are suited to the particular use contemplated. Thus, the invention is not limited in its execution to the abovementioned preferred exemplary embodiments. Rather, a number of variants are conceivable that make use of the illustrated solution even in the form of fundamentally different embodiments. All such modifications and variations are within the scope of the invention as determined by the appended claims when interpreted in accordance with the breadth to which they are fairly, legally, and equitably entitled.

The invention claimed is:

1. A cooling device with a heat exchanger unit through which air can flow and at least one fan that is arranged on the heat exchanger unit that generates an airflow through the heat exchanger unit, wherein the heat exchanger unit has a front face through which the air can flow which points toward the fan and which is covered in portions by the fan, so that the front face is divided into a first subface that is at least partially covered by the fan and a second subface that is free of the fan, wherein the fan is offset or spaced apart from the heat exchanger unit in an axial direction (X), wherein the cooling device has a guide sleeve, which is arranged between the heat exchanger unit and the fan, so as to close, at least in portions, a radial gap present between the fan and the heat exchanger unit, wherein the guide sleeve forms a flow channel leading from an air outlet of the fan to the first subface of the front face, and fluidically connects the air outlet of the fan to the first subface of the front face and fluidically separates the same from the second subface;

wherein the fan has a wall on a heat exchanger side which extends in a circumferential direction (U) and overlaps with the guide sleeve in the axial direction (X), so that the guide sleeve covers the wall of the fan in the circumferential direction (U) or the wall of the fan extends around the guide sleeve in the circumferential direction (U);

wherein an axial gap is formed between the guide sleeve and the wall of the fan, wherein axial movement of the fan or the wall of fan due to oscillation or vibration of the fan may freely occur through the axial gap relative to the guide sleeve.

2. The cooling device as set forth in claim 1, wherein the guide sleeve is embodied as a hollow cylinder and/or is rotationally symmetrical, wherein the guide sleeve is arranged coaxially with an axis of rotation (R) of an impeller of the fan.

3. The cooling device as set forth in claim 1, wherein the guide sleeve is formed integrally with the heat exchanger unit or is connected thereto in a single piece.

4. The cooling device as set forth in claim 1, wherein the guide sleeve is formed integrally by the fan or is connected thereto in a single piece.

5. The cooling device as set forth in claim 1, wherein the guide sleeve rests directly against the heat exchanger unit.

6. The cooling device as set forth in claim 1, wherein the guide sleeve further comprises a sealing element which assists in closing the radial gap between the fan and the heat exchanger unit.

7. The cooling device as set forth in claim 6, wherein the sealing element is embodied as a bellows or skirt, has a first end that is secured in the axial direction (X) to the guide sleeve and a free second end that is oppositely situated in the axial direction (X), and is designed to be stretched by the airflow generated by the fan in the axial direction (X) from a non-deformed first position into a deformed second position, so that the radial gap is completely closed in the second position.

8. The cooling device as set forth in claim 1, wherein the guide sleeve is dimensionally stable and rigid.

9. The cooling device as set forth in claim 1, wherein the guide sleeve has a wall that extends around in the circumferential direction (U) and a flange that extends beyond the wall in a radial direction (Y) on the heat exchanger side and/or fan side.

10. The cooling device as set forth in claim 9, wherein the flange has a plurality of bristles toward the front face by means of which the flange is designed to penetrate through the front face into the heat exchanger unit.

11. The cooling device as set forth in claim 1, wherein an axis of rotation (R) of an impeller of the fan is coaxial with a central axis of the heat exchanger unit, which is orthogonal to the front face and extends centrally through the front face.

12. The cooling device as set forth in claim 1, wherein the fan is secured in a fixed position relative to the heat exchanger unit.

13. A motor vehicle comprising the cooling device as set forth in claim 1.

* * * * *